US008360895B2

(12) United States Patent
Brown

(10) Patent No.: US 8,360,895 B2
(45) Date of Patent: Jan. 29, 2013

(54) WATER SLIDE WITH BANKED CURVE OBSTACAL REGION

(76) Inventor: Jana Brown, Grand Junction, CO (US)

( * ) Notice: Subject to any disclaimer, the term of this patent is extended or adjusted under 35 U.S.C. 154(b) by 309 days.

(21) Appl. No.: 12/925,447

(22) Filed: Oct. 22, 2010

(65) Prior Publication Data

US 2012/0100921 A1 Apr. 26, 2012

(51) Int. Cl.
*A63G 21/18* (2006.01)
*A63G 21/00* (2006.01)

(52) U.S. Cl. ..... 472/117; 472/116

(58) Field of Classification Search ..... 472/13, 472/116, 117, 128, 129; 4/488, 494; 104/55, 104/69, 70
See application file for complete search history.

(56) References Cited

U.S. PATENT DOCUMENTS 4,339,122 A * 7/1982 Croul ..... 472/88
4,550,910 A * 11/1985 Goldfarb et al. ..... 104/305
5,154,671 A * 10/1992 Smollar et al. ..... 472/117
5,551,922 A * 9/1996 Katz et al. ..... 472/117
7,361,096 B2 * 4/2008 Sanchez ..... 472/117
7,780,537 B2 * 8/2010 Hlynka ..... 472/117

* cited by examiner

*Primary Examiner* — Kien Nguyen
(74) *Attorney, Agent, or Firm* — Scott L. Terrell, P.C.; Scott L. Terrell

(57) ABSTRACT

A water slide is provided to for recreation and amusement. The water slide includes a plastic strip of sliding sheet material forming a sliding surface. The sheet material is configured so that a central curved region is positioned between an elongated entry and an elongated exit regions. The sliding surface has an inner and an outer periphery. A curved and outwardly extending banked obstacle region is positioned in the central curved region. The obstacle region includes a bottom wall, at least one outer load bearing side wall, and a top wall. The top wall is also of sliding sheet material and is contiguous with the sliding surface. The banked obstacle region forms a valley for interconnection with the elongated entry and exit regions. The bottom wall, side wall, and top walls further define at least one hollow inner chamber. A load supporting medium is contained in the hollow inner chamber so that the obstacle region bears a sliding load. A sprinkler tube is connected to the outer periphery of the sliding surface so that a spray of water is delivered to the sliding surface when coupled to a pressurized water supply.

10 Claims, 3 Drawing Sheets

WATER SLIDE WITH BANKED CURVE OBSTACAL REGION

CROSS REFERENCE TO RELATED APPLICATIONS

None.

BACKGROUND OF THE INVENTION

1. Field of the Invention

The present invention relates to water slides for amusement and recreation. In particular, it relates to a water slide with a banked curved obstacle region.

2. Description of the Related Art

Toy water slides generally include an elongated strip of plastic sheet material which staked down on the lawn. These water slides also include a water sprinkler coupling which connects to a water sprinkler tube seam-welded to the plastic sheet along a peripheral edge so that a spray of water is directed to moisten the sliding surface, in order to make the surface slick. In use, a child runs toward the elongated strip of plastic sheet and flops on to it. The running inertia of the child causes the child to slide over the sliding surface and exit onto the lawn at the point where the plastic sheet terminates in length.

In order to add more amusement, a number of features have been added to prior art slides including the addition of hoops, shallow pools, and various forms of pillow like bumps to raise the child at different locations along the plastic sheet when sliding. For example, U.S. Pat. No. 5,551,922, to Katz et al, discloses a backyard toy slide that has a sliding sheet terminating in a pool. An inflatable side wall along the pool defines a serpentine pathway, through the pool, so that a child sliding on the slide follows a zig-zag path through the pool prior to sliding off the exit end of the slide. A water hose sprinkler attachment is included which, when coupled to a water supply hose, provides a spray of water to wet the slide and make the surface slick.

While the foregoing examples offer some utility, it is still desirably to provide a water slide which serves to add to the amusement of the user and to decelerate the running inertia prior to exiting the slide onto the lawn. The present invention satisfies these needs.

BRIEF SUMMARY OF THE INVENTION

It is therefore an object of the present invention, to provide a water slide which serves to add to the amusement of the user.

It is another object of the present invention, to provide a water slide which serves to add to the amusement of the user and to decelerate the running inertia prior to exiting the slide onto the lawn.

To overcome the problems associated with the prior art and, in accordance with the purpose of the invention, as embodied and broadly described herein, briefly a water slide having a banked curve region is provided to for recreation and amusement. The water slide includes a plastic strip of sliding sheet material forming a sliding surface. The sheet material is configured so that a central curved region is positioned between an elongated entry and an elongated exit region. The sliding surface has an inner and an outer periphery. A curved and outwardly extending banked obstacle region from the inner to the outer periphery is positioned in the central curved region. The obstacle region includes a bottom wall, at least one outer load bearing side wall, and a top wall. The top wall is also constructed of the sliding sheet material, and is contiguous with the sliding surface. The banked obstacle region forms a valley for interconnection with the elongated entry and exit regions. The bottom wall, side wall, and top walls further define at least one hollow inner chamber. A load supporting medium is contained in the hollow inner chamber so that the obstacle region bears a sliding load. A curved sprinkler tube is connected to at least one of the peripheries of the sliding surface so that a spray of water is delivered to the contiguous sliding surface when coupled to a pressurized water supply.

Additional advantages of the present invention will be set forth in part, in the description that follows, and in part will be obvious from that description or can be learned from practice of the invention. The advantages of the invention can be realized and are obtained by the invention which is particularly pointed out in the appended claims.

BRIEF DESCRIPTION OF THE SEVERAL VIEWS OF THE DRAWINGS

The accompanying drawings, which are incorporated in and which constitute a part of the specification illustrate at least one embodiment of the invention and, together with the description, explain the principles of the invention.

DETAILED DESCRIPTION OF THE INVENTION

Figure 2:
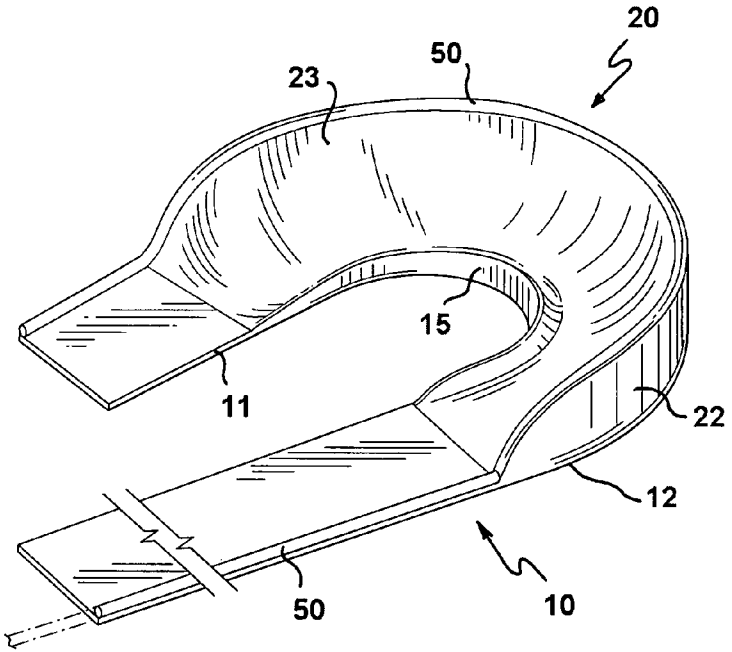
FIG. 2 is a perspective view the embodiment of the present invention where the curved obstacle portion is generally U-shaped.
Figure 1:
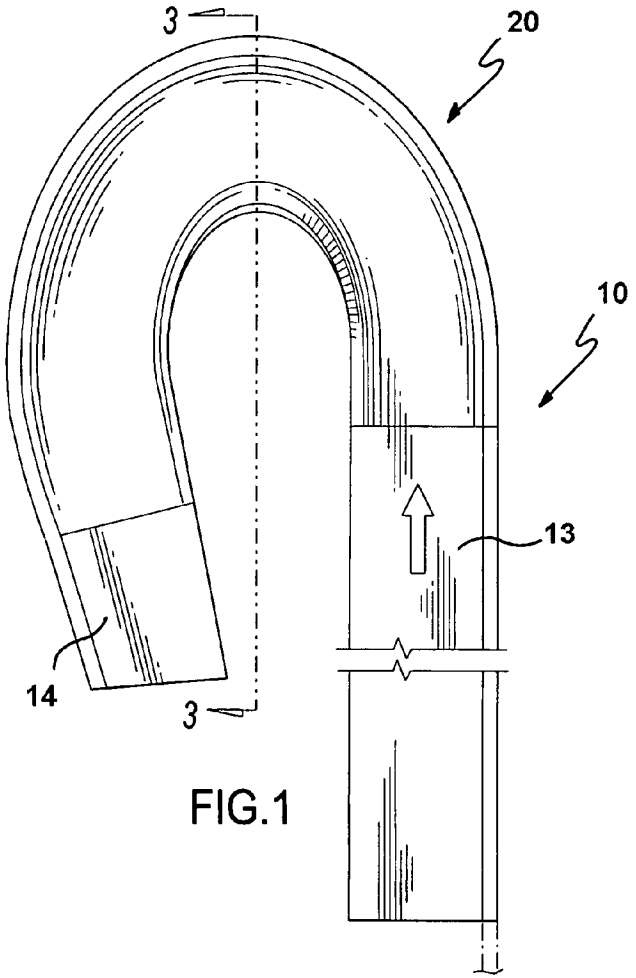
FIG. 1 is a top view showing an embodiment of the present invention where the curved obstacle portion is generally U-shaped.
Figure 3:
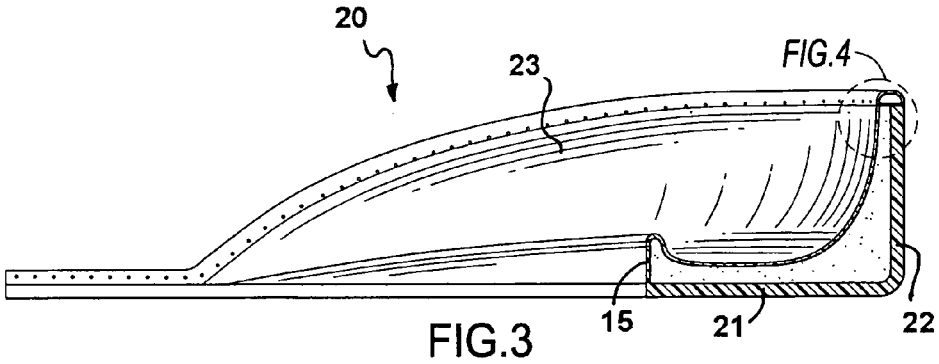
FIG. 3 is a side sectional view showing the preferred configuration of the hollow inner chamber of the curved obstacle region together with stiffened side and bottom walls for use in constructing the curved obstacle region.
Figure 4:
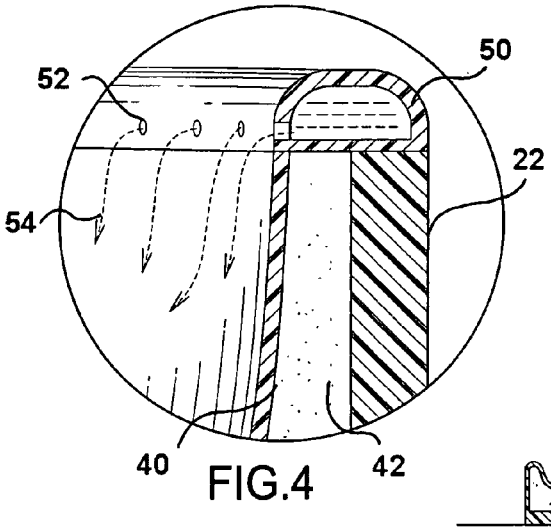
FIG. 4 is an enlarged side sectional view showing the sprinkler tube welded along the outer peripheral surface of the sliding sheet and side wall in the curved obstacle region.
Figure 6:
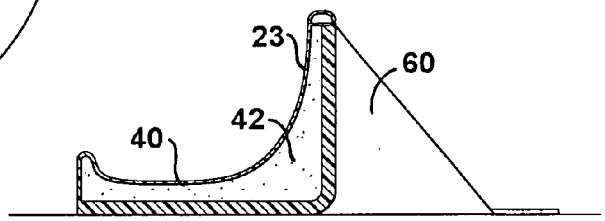
FIG. 6 is a side sectional view of another embodiment of the present invention showing the load bearing side wall supported with a series of lateral supporting braces which are connected to extend outwardly from the sidewall so that the sidewall is stiffened with respect to a lateral sliding load.
Figure 5:
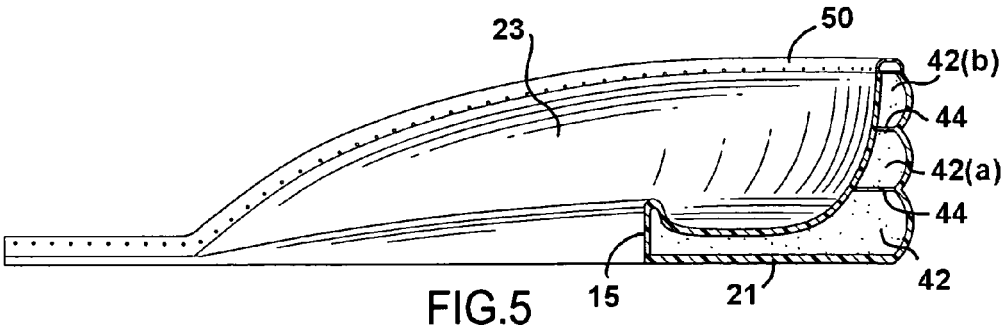
FIG. 5 is side sectional view of showing the curved obstacle region hollow inner chamber in an embodiment where the chamber is constructed with horizontal baffles to further stiffen the curved region against lateral and horizontal forces when sliding.
Figure 9:
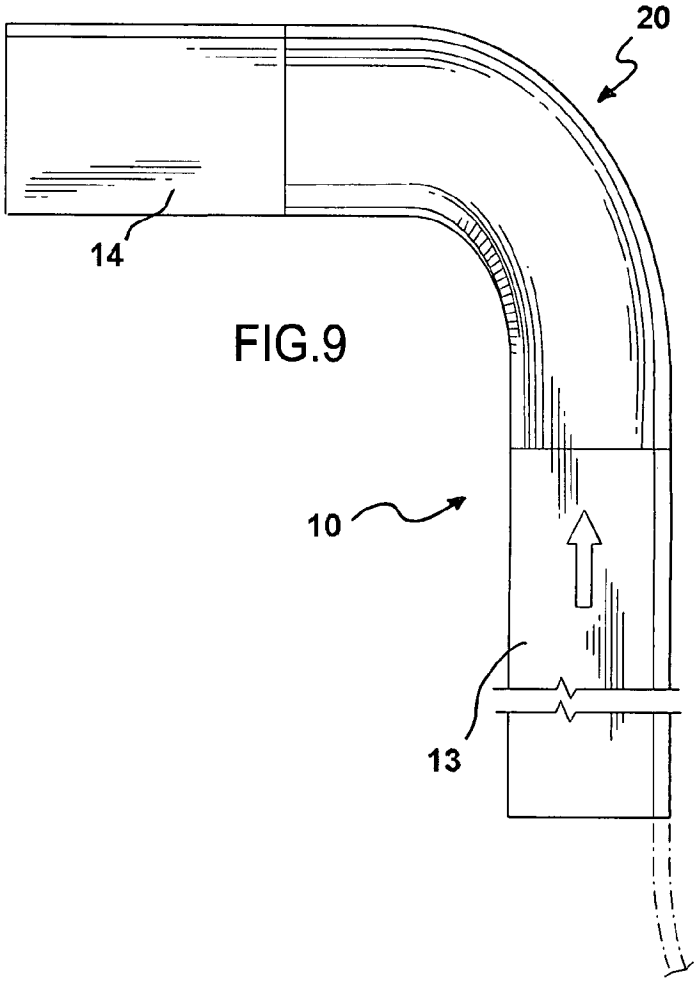
FIG. 9 is a top view of another embodiment of the present invention showing the curved obstacle region constructed so as to form a right angle entry and exit regions.
Figure 7:
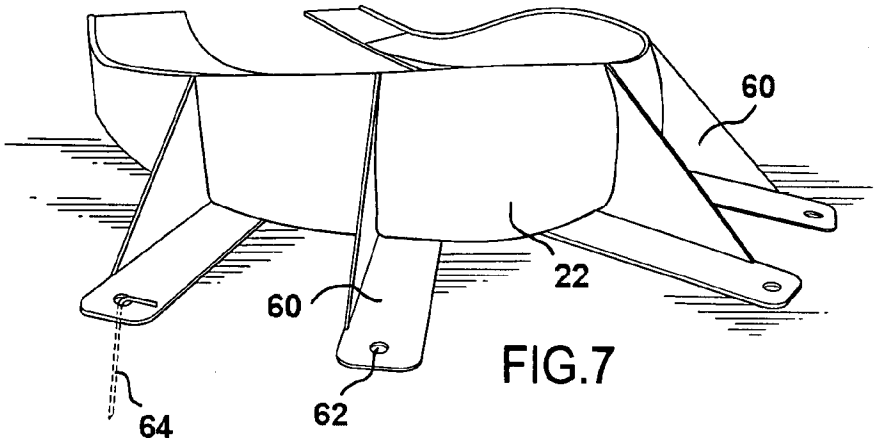
FIG. 7 is a perspective rear view of another embodiment of the present invention showing the load bearing side wall in the curved obstacle region with the series of lateral supporting braces which are connected to extend outwardly from the sidewall with clear holes for staking the braces into the ground.
Figure 8:
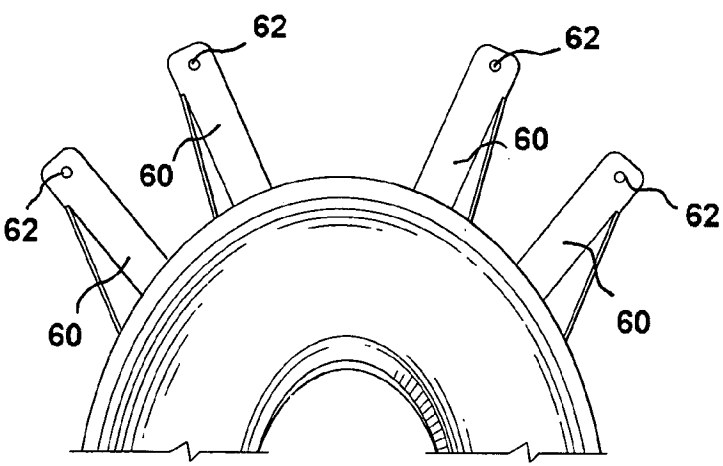
FIG. 8 is a top view of the embodiment where the load bearing side wall of the curved obstacle region is supported with the lateral supporting braces.

Unless specifically defined otherwise all technical or scientific terms used herein have the same meaning as commonly understood by one of ordinary skill in the art to which this invention belongs.

Although any of the methods and materials similar or equivalent to those described herein can be used in the practice or testing of the present invention, the preferred methods and materials are now described. Reference will now be made in detail to the presently preferred embodiments of the invention, examples of which are illustrated in the accompanying drawings wherein like numerals represent like features of the invention.

Referring now to the drawing figures, the preferred embodiment of the present invention provides a water slide 10 with a banked curve obstacle region 20 which is useful for recreation and amusement. The water slide 10 includes a plastic strip of sliding sheet material forming a sliding surface. The sliding sheet is constructed of a durable plastic material that will allow a child to slide upon when wet. The sliding sheet may, but need not, be secured to the lawn with fasteners, such as stakes pushed into the ground, along its inner 11 and outer 12 peripheries. The sheet material is configured so that a central curved region is positioned between an elongated entry 13 and 14 exit regions. The central curved region is preferably configured to provide a curve radius in the range of 90 to 180 degrees.

A curved and outwardly extending banked obstacle region 20 is positioned in the central curved region. The curved and banked obstacle region 20 is banked with a valley extending from the inner 11 to the outer periphery 12. The obstacle region 20 includes a bottom wall 21, at least one outer load bearing side wall 22, and a top wall 23. The top wall 23 is also constructed of the same or similar, durable plastic sliding sheet material so that it forms a contiguous sliding surface with the elongated entry 13 and elongated exit 14 regions. The banked obstacle region 20 desirably forms a valley, or concave top wall 23 surface, and ramps upwardly and downwardly, from the entry 13 to the exit 14 respectively, for interconnection with the elongated entry 13 and exit 14 regions. The inner periphery 11 of the banked obstacle region 20 is by necessity shorter in length and may, but need not, include a lip 15, or flanged portion, extending upwardly for holding a quantity, or pool, of water along a bottom portion of the top wall 23 of the banked curve region 20. In this manner the user, when sliding around the corner and downward from the outer 12 to the inner 11 periphery along the banked portion of the curve, slides against the inner lip 15 into the pool of water for ease in sliding and splashing through the bottom portion of the banked curve region 20.

The bottom wall 21, side wall 22, and top wall 23 further define at least one hollow inner chamber 40. While the top wall 23 is desirable constructed using the durable plastic sliding sheet material, and the bottom 21 and side 22 walls are desirable constructed of a thicker, or heavier, material of latex (vulcanized rubber) bonded with a cotton or canvas reinforcing material, so as to protect against abrasion or puncture. The hollow inner chamber 40 is also desirably internally baffled with a series of horizontal 44 and/or vertical (not shown) baffles which serve to stabilize a load supporting medium 42, 42(*a*), 42(*b*) filling the chambers, when in use. A layer of foam (not shown) along a top portion of the sidewall 22 may further be welded into the seam in order to provide added cushioning.

A load supporting medium 42 is contained in the hollow inner chamber 40 so that the obstacle region 20 bears a sliding load force. The load supporting medium 42 is desirably pressurized air, but may also include water, foam, an aggregate material, such as sand, or any combination of the above mediums, the selection of which is depending on a predetermined configuration of the baffles and desired use. As above, the hollow inner chamber 40 desirably includes a series of internal horizontal 44 and/or vertical baffles in order to provide multiple chambers within the inner chamber 40 in order to reduce movement of the load supporting medium 42 upon the application of a lateral force which is generated by the user, when sliding. When constructing the hollow inner chamber 40 to include horizontal baffles 44 it is also desirable to further construct the baffle portions so that the lower baffled portion of the inner chamber 40 holds a supporting medium comprised of water, with upper baffled chambers 42(*a*), 42(*b*) constructed to hold air, as the supporting medium. In this manner, the lower baffled portion of the inner chamber also serves as a weight which is useful to enable the banked curve region 20 to resist lateral movement when in use.

A sprinkler tube 50 is connected, or welded, to the inner 11 or outer 12 periphery of the sliding surface so that a spray of water is delivered to the contiguous sliding surface when coupled to a pressurized water supply. When welded to the outer 12 periphery (as illustrated), the sprinkler tube 50 desirably includes a plurality of pin holes 52 running along its outer periphery so that the spray of water 54 is directed upwardly to fall in a direction toward the center of the sliding surface at the elongated entry 13 and exit 14 portions, but may be proportionally directed then downwardly (not shown) to run parallel with the sliding surface when running along the banked curve obstacle region 20 of the water slide 10.

In yet another embodiment of the present invention, the water slide 10 may, but also need not, include a plurality of lateral supporting braces 60 which are biased or connected outwardly against the sidewall 22 of the obstacle region 20 so that the sidewall 22 is stiffened with respect to a lateral load. The lateral braces 60 are desirably constructed of right-angled members including clear holes 62 position adjacent to the ground for securing the braces 60 with stakes 64. The lateral braces 60 may be constructed of a rigid plastic material, and preferably include a complimentary contour shape so as to bias uniformly against the sidewall 22.

While the present invention has been described in connection with the embodiments as described and illustrated above, it will be appreciated and understood by one of ordinary skill in the art that certain modifications may be made without departing from the true spirit and scope of the invention, as described and claimed herein.

I claim:

1. A water slide for recreation and amusement, comprising:

(a) a plastic strip of sliding sheet material forming a sliding surface and configured so that a central curved region is positioned between an elongated entry and an elongated exit region, the sliding surface having an inner and an outer periphery;

(b) a curved and outwardly extending banked obstacle region extends from the inner to the outer periphery in the central curved region and includes a bottom wall, at least one outer load bearing side wall, and a top wall so that the top wall is contiguous with the sliding surface, and the banked obstacle region forming a valley for interconnection with the elongated entry and exit regions, the bottom wall, side wall, and top walls further defining at least one hollow inner chamber;

(c) a load supporting medium contained in the hollow inner chamber so that the obstacle region bears a sliding load; and (c) a sprinkler tube connected to at least one of the peripheries of the sliding surface so that a spray of water is delivered to the sliding surface when coupled to a pressurized water supply.

2. The water slide according to claim 1, wherein the hollow inner chamber load supporting medium further includes a plurality of baffles.

3. The water slide according to claim 2, wherein the inner chamber load bearing chamber includes a lower baffled chamber filled with water as the load supporting medium and at least one upper baffled chamber filled with air as the load supporting medium.

4. The water slide according to claim 1, wherein the supporting material is pressurized air.

5. The water slide according to claim 1, wherein the supporting material is water.

6. The water slide according to claim 1, further comprising a plurality of lateral supporting braces connected outwardly to obstacle region so that the sidewall is stiffened with respect to a lateral load.

7. The water slide according to claim 6, wherein the braces are contoured in relation to the sidewall.

8. The water slide according to claim 6, wherein the braces include a clear hole for receiving a stake.

9. The water slide according to claim 1, wherein the bottom wall and side walls include reinforced latex material.

10. The water slide according to claim 1, wherein the sprinkler tube is welded to the outer periphery.

* * * * *